US005759590A

United States Patent [19]

Cacossa

[11] Patent Number: 5,759,590

[45] Date of Patent: Jun. 2, 1998

[54] SPACKLING TOOL

[76] Inventor: Frank G. Cacossa, 93 Martin Rd., Livingston, N.J. 07039

[21] Appl. No.: 846,282

[22] Filed: Apr. 30, 1997

[51] Int. Cl.[6] ..... B28B 17/00

[52] U.S. Cl. ..... 425/183; 425/458; 15/235.4; 15/235.8

[58] Field of Search ..... 425/458, 183; 15/235.8, 235.4, 105; D8/45

[56] References Cited

U.S. PATENT DOCUMENTS

| | | | |
|---|---|---|---|
| 2,759,218 | 8/1956 | Smith | 425/458 |
| 2,800,672 | 7/1957 | Gilyan | 15/235.8 |
| 3,023,444 | 3/1962 | Tims, Jr. | D8/45 |
| 3,878,581 | 4/1975 | Perna . | |
| 4,090,914 | 5/1978 | Hauk et al. . | |
| 4,196,028 | 4/1980 | Mills et al. . | |
| 4,197,624 | 4/1980 | Lass . | |
| 4,391,013 | 7/1983 | Janssen . | |
| 4,399,170 | 8/1983 | Janssen . | |
| 4,452,663 | 6/1984 | Heaton . | |
| 4,495,668 | 1/1985 | Adams | 15/105 |
| 4,592,797 | 6/1986 | Carlson . | |
| 4,654,919 | 4/1987 | Liberman . | |
| 4,731,258 | 3/1988 | Liberman . | |
| 4,996,941 | 3/1991 | Mills . | |
| 5,137,752 | 8/1992 | Mills . | |
| 5,522,199 | 6/1996 | Pearce . | |
| 5,545,287 | 8/1996 | Carlson . | |

*Primary Examiner*—Jay H. Woo
*Assistant Examiner*—Robert Hopkins
*Attorney, Agent, or Firm*—Lerner, David, Littenberg, Krumholz & Mentlik

[57] ABSTRACT

A spackling tool is provided. The spackling tool includes multiple blades, each having a different width. The spackling tool of the present invention can be used to efficiently apply spackle material or the like to a work surface until a desired finished work product is obtained.

24 Claims, 5 Drawing Sheets

SPACKLING TOOL

FIELD OF THE INVENTION

The present invention relates to spackling tools which are commonly known as "taping knives" or "putty knives". More particularly, the present invention relates to a spackling tool having multiple blades.

BACKGROUND OF THE INVENTION

It is known to those skilled in the home repair and contractor's trade that several coats of spackle material, joint compound or the like are required in order to obtain a professional finished appearance to tape joints on sheet rock walls and spackled repairs of gauges, holes, etc. As used herein, the term "spackle material" is intended to cover various types of spackle, joint compound, putty and other workable somewhat viscous compounds used in the construction industry and home repair fields. The term "taping knife" is intended to cover "putty" knives and other tools including relatively flat, elongated blades which are used to apply spackle material to a surface. Such tools are also collectively described herein as "spackling tools".

More particularly, when repairing damaged sheet rock walls, those skilled in the construction trade may apply three coats of spackle to a selected location on a sheet rock wall. In order to complete the repair job so that it appears substantially seamless and unnoticeable to the homeowner, it has heretofore been required to use several different taping knives having increasing blade widths to apply the respective coats of spackle. For example, the first taping knife may typically have a flat blade including a width at its free end of about 3¼". The second taping knife used to apply a second coat of spackle typically may have a width of approximately 6". While the third taping knife used to apply the third and final coat of spackle may have an even greater width of about 10" at its free end. Through the use of the three separate taping knives, having increasing blade widths, a completed repair job having a smooth surface could be obtained.

After the spackle had been applied as discussed above, the contractor could then paint over the completed repair job. Although a desirable result can be obtained when using the three separate taping knives, this approach requires that each contractor, or homeowner, must purchase three separate tools in order to properly apply spackle to a wall surface. As used herein, the term "wall surface" is intended to include walls, doors, ceilings, flooring or any other substantially flat surface to which spackle material may be applied.

Prior art inventors have expended great efforts in attempting to design improved spackling tools. Notwithstanding these efforts, no spackle tool has heretofore been designed which would eliminate the need for contractors to purchase multiple taping knives in order to properly apply multiple coats of spackle to a wall surface.

SUMMARY AND OBJECTS OF THE PRESENT INVENTION

The present invention addresses the shortcomings of prior art taping knives by providing a single spackling tool which can be used to replace the three separate taping knives which were heretofore required in order to obtain the most desirable result when performing spackling procedures.

In accordance with a preferred embodiment of the present invention, a spackling tool comprising a handle is provided. The spackling tool also comprises a first blade having a connecting end secured to the handle, and a free end spaced from the handle. The free end of the spackling tool has a first predetermined width and is constructed and arranged to apply spackle material to a wall surface. The first blade of the spackling tool is preferably substantially elongated and includes generally flat opposing front and rear surfaces. The spackling tool may also comprise at least a second blade having a free end with a second predetermined width which is greater than the first predetermined width of the first blade. The second blade may also be substantially elongated and may also have generally flat opposing front and rear surfaces. The second blade is preferably removably mounted on the first blade and is arranged at a location where the free end thereof extends beyond the free end of the first blade.

Preferably, the spackling tool also comprises a third blade having a free end with a third predetermined width which is greater than the second predetermined width of the second blade. The third blade is also substantially elongated and may have generally opposing front and rear flat surfaces. The third blade may be removably mounted on the first blade in conjunction with the second blade so that the free end of the third blade can selectively be arranged to extend beyond the free end of the first and second blades.

It should be appreciated that only one of the free ends of the first, second or third blades can be extended from the handle at a furthest-most position at any particular time.

The spackling tool may also comprise retaining means for supporting at least the second or third blades in assembled position on the first blade. The retaining means may be formed at least partially on the front surface of the first blade. In a preferred embodiment, the retaining means may comprise at least one tab extending outwardly from the front surface of the first blade, whereby the second or third blades are supported by the at least one tab at a predetermined spaced distance from the handle. In another preferred embodiment, the at least one tab comprises a pair of spaced tabs, each being used to support a removably second or third blade in assembled position on the first blade.

In another preferred embodiment, the retaining means should be arranged on the handle. In particular, the retaining means may be arranged in a groove formed on the top of the handle. In this preferred embodiment, the free end of one of the second or third blades may be arranged in the groove at the top of the handle so that the free end of the other one of the second or third blade will extend beyond the free end of the first blade.

When the spackling tool comprises three blades, the second and third blades may be secured together and may be selectively and removably mounted in a desired location on the first blade.

It is also preferable for the second and third blades to be secured together in a blade assembly so that the free ends of those blades are arranged at opposing sides of the blade assembly. Thus, when the blade assembly having this preferred structure is mounted on a first blade, the free end of either the second or third blade will face the handle while the free end of the other blade will extend beyond the free end of the first blade. In other words, the free end of the second blade may be arranged to extend beyond the free end of the first blade when the free end of the third blade is adjacent the at least one tab of the retaining means. Where the retaining means comprises a groove at the top of the handle, the free end of the third blade would be adjacent such groove in order to obtain the configuration discussed above. The configuration of the spackling tool may be modified by removing the blade assembly which comprises the second and third blade from its mounted position on the first blade. The free end of the third blade may then be arranged to extend beyond the free end of the first blade. At this time, the free end of the second blade will be placed adjacent the at least one tab, or the groove, of the retaining means.

The blade assembly formed by the second and third blades may comprise a pocket formed between the second and third blades. In this preferred embodiment, the first blade may be arranged within the pocket when the blade assembly is mounted in assembled position.

In a preferred embodiment, guide members may be used to secure the second and third blades together. The guide members may define the width of the pocket of the blade assembly. This width may be slightly greater than the first predetermined width of the free end of the first blade so that the first blade can extend within the pocket wherein the free end thereof extends between the guide members. The guide members may comprise a pair of threaded bolts. In this embodiment, the second and third blades may have a pair of spaced apertures through which the threaded bolts extend.

In order to facilitate tightening and loosening of the blade assembly in assembled position on the first blade, the spackling tool may comprise a pair of threaded nuts arranged on respective ones of the pair of threaded bolts. As the threaded nuts are loosened, the blade assembly can be removed from its assembled position on the first blade. Similarly, as the threaded nuts are tightened, the blade assembly may be secured in its assembled position on the first blade. In another preferred embodiment, the guide members may comprise a pair of rivets.

In still another embodiment, the second and third blades may be formed as an integral and removable blade assembly. In this embodiment, the free ends of the second and third blades will be mounted on opposing sides from each other. A band may be connected at a central location between the free ends of the second and third blades so that a pocket is formed in which the first blade assembly can be placed for mounting the second and third blades in assembled position on the first blade.

Although the widths of the free ends of the first, second and third blades are not limited within the scope of the present invention, in a preferred embodiment, the first predetermined width of the first blade is between about 1"–5" wide. The second predetermined width of the second blade may be between about 3"–8" wide, and the third predetermined width of the third blade may be between about 6"–14" wide. In an even more preferred embodiment, the first predetermined width may be between about 3"–4" wide, the second predetermined width may be between about 5"–7" wide and the third predetermined width may be between about 8"–12" wide.

It is an object of the present invention to provide a spackling tool which can be used to apply spackle material to a wall surface so that a particularly high quality finished work product can be obtained.

It is another object of the present invention to provide a spackling tool which will eliminate the need to purchase three separate taping knives in order to properly perform a spackling job.

These and other features, objects and advantages of the present invention will be more readily understood when viewed in conjunction with the following detailed description of the preferred embodiments and the drawings of the present invention.

DETAILED DESCRIPTION OF THE PREFERRED EMBODIMENTS

A first embodiment of a spackling tool 10 is shown in FIGS. 1–4. The spackling tool 10 includes a handle 12 which may be made out of plastic, wood, metal or the like which is held used to hold the spackling tool 10 during work operations.

Figure 1:
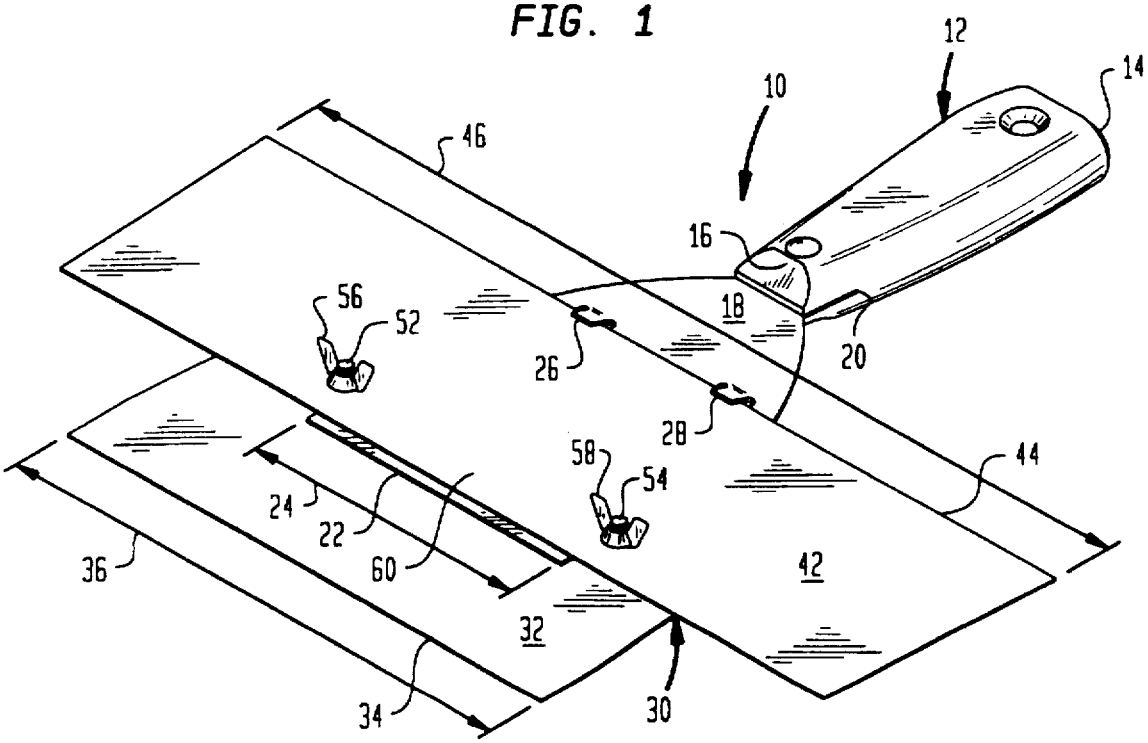
FIG. 1 is a front perspective view of a first embodiment of a spackling tool shown in assembled position with the second blade arranged in a work position.
Figure 2:
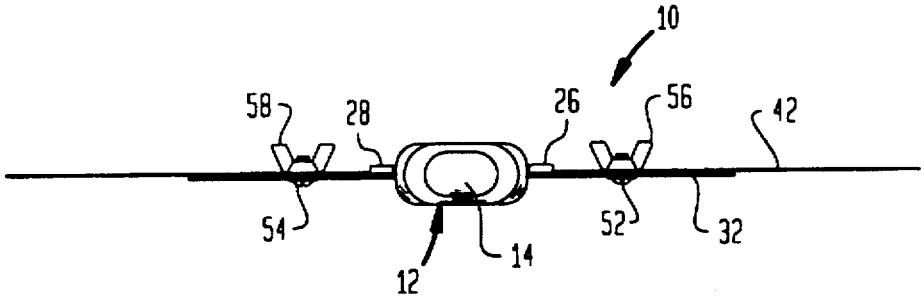
FIG. 2 is a rear view of the assembled spackling tool shown in FIG. 1.
Figure 3:
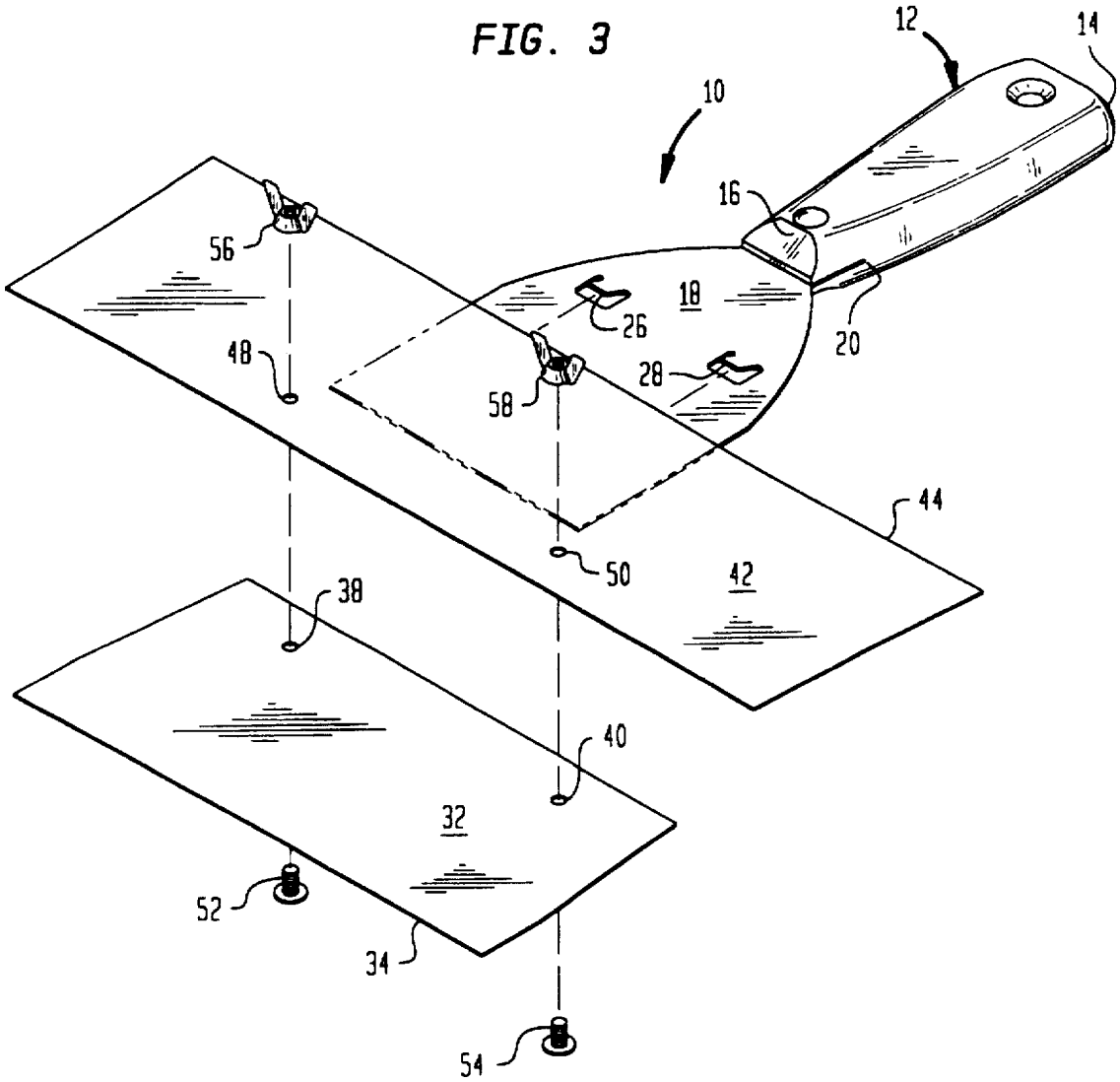
FIG. 3 is a front perspective exploded view of the spackling tool shown in FIG. 1.

As shown in FIGS. 1–3 the handle 12 includes a bottom end 14 at a remote location from the blades, and a top end 16 which is connected to a first blade 18. The first blade 18 is also shown in FIGS. 1–3. The first blade 18, and the second and third blades discussed below, are typically made out of metallic material. However, the blade structures can also be made out of plastic or other substantially rigid material which have the requisite degree of rigidity and flexibility.

The first blade 18 includes a bottom end, or a connecting end, which is secured to the top end 16 of the handle 12. The first blade 18 also includes a free end 22 which has a predetermined width designated by reference numeral 24. The free end 22 is used to "work" spackle material during mixing, applying or other work operations. The width 24 of the free end 22 may vary depending upon the particular operation for which the spackling tool 10 is needed. In one preferred embodiment, the width 24 may be approximately 3¼", which is a standard width of the free end of prior art taping knives used for applying spackle material to a wall surface. Thus, it should be appreciated that the structure of the core assembly of the spackling tool 10 comprises the handle 12 and the first blade 18.

The basic dimensions, and structural features of this core assembly is similar to prior art taping knives. As illustrated in the embodiment of FIGS. 1 and 3, the front surface of the first blade 18 comprises a pair of retaining tabs 26 and 28 which extend outwardly. As discussed further below, the retaining tabs 26 and 28 are used to retain a blade assembly 30 comprising second and third blades 32 and 42 in a supported position on the first blade 18.

The structure of the blade assembly 30 can be appreciated from FIGS. 1–4. The blade assembly 30 comprises a second blade generally designated 32 which has a free end 34 including a width 36. Although the dimensions of the width 36 may vary in accordance with the particular application for which the spackling tool 10 will be used, the width 36 may comprise about six inches in a preferred embodiment. The free end 34 of the second blade 32 is used to work with spackle material during various operations as discussed further below.

In the embodiment of the present invention shown in FIGS. 1–4, apertures 38 and 40 extend through the second blade 32.

Figure 4:
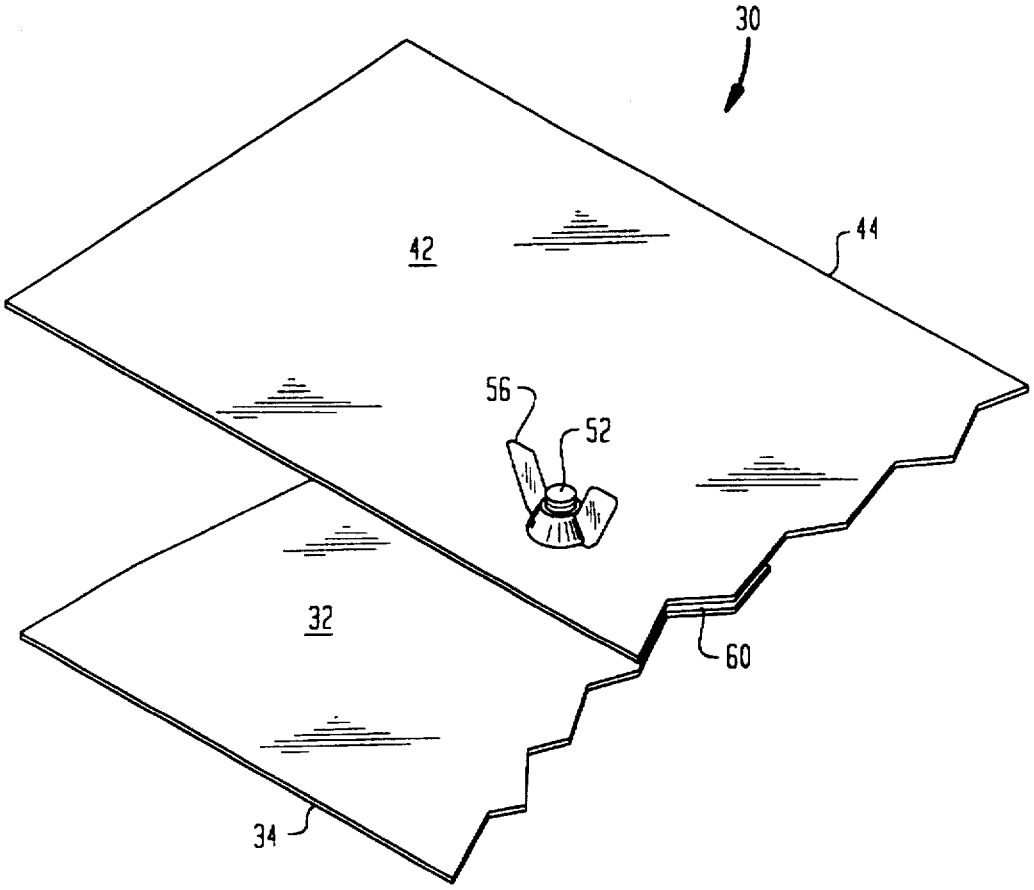
FIG. 4 is an isolated perspective front view of a first embodiment of a blade assembly comprising second and third blades in assembled position.

A third blade 42 having a free end 44 and a predetermined width 46 is also shown in FIGS. 1–4. The third blade 42 also includes a pair of spaced apertures 48 and 50 which are aligned with apertures 38 and 40 of the second blade 32. A pair of threaded bolts 52 and 54 extends through aligned apertures 38, 40, 48 and 50 when the blade assembly 30 is in assembled position as shown in FIGS. 1, 3 and 4. A pair of threaded wing nuts 56 and 58 are arranged on respective threaded bolts 52 and 54 to facilitate tightening of the blade assembly 30 so that the second blade 32 and the third blade 42 are assembled as a unit for mounting on the first blade 18.

A pocket 60 is formed between the second and third blades. The pocket 60 has a width defined by the location of the threaded bolts 52 and 54 through the aligned apertures. The width of the pocket 60 is sufficient to accommodate the width 24 of the free end 22 of the first blade 18. Preferably, the width defined by the threaded bolts 52 and 54 of the pocket 60 is slightly greater than the width 24 of the free end 22 so that the blade assembly 30 can be mounted in a relatively secured position on the first blade 18. Thus, the threaded bolts 52 and 54 also serve as guide members through which the first blade 18 is guided when the spackling tool 10 is assembled.

As known in the prior art, it is desirable to apply several coats of spackle material to a wall surface in order to obtain a smooth and professional finished product. Three separate taping knives have been used in the prior art to obtain the desired finished result. For example, a first taping knife having a blade including a free end having a width of approximately 3¼" was required to apply the initial spackle material to a wall surface. A second coat of spackle material was then applied with a second taping knife which included a blade with a free end which was wider than the free end of the blade of the first taping knife. The free end of the second taping knife may have been approximately six inches wide. In order to apply the third and final coat of spackle material to a wall surface, a third taping knife having a blade with a ten inch width at its free end was used. After the third coat of spackle material was applied to the wall surface, the wall was ready to be painted and a particularly high quality finished appearance was obtained.

The spackling tool 10 of the present invention can be used to obtain the same high quality finished work product as previously obtained through prior art taping knives. The difference is the spackling tool 10 of the present invention can accomplish the same results that previously required three separate taping knives.

When it is desired to apply a first coat of spackle material to a wall surface, the blade assembly 30 which comprises the second blade 32 and the third blade 42, should be removed from its assembled position on the first blade 18. This may be accomplished by loosening the wing nuts 56 and 58 and thereafter sliding the first blade 18 out of the pocket 60 formed between the second blade 32 and the third blade 42. For this initial application of spackle material, the spackling tool 10 may appear much like a prior art 3¼" taping knife. After applying the initial coat of the spackle material onto the wall surface with the free end 22 of the first blade 18, the first coat of spackle material is permitted to dry.

In order to apply a second coat of spackle material to the work site on the wall surface, it is required to assemble the blade assembly 30 in its mounted position on the first blade 18. This can be easily accomplished by sliding the free end 22 of the first blade 18 into the pocket 60 between the guide members (i.e., the threaded bolts 52 and 54) thereof. The free end 44 of the third blade 42 should be facing downwardly (i.e., toward the handle 12) and is supported in a mounted position on the front surface of the first blade 18 by the retaining tabs 26 and 28. At this time, the free end 34 of the second blade 32 extends beyond the free end 22 of the first blade 18. Thus, the width 36 of the free end 34 of the second blade 32 is now in a work position. The wing nuts 56 and 58 should be tightened until the blade assembly 30 is securely mounted on the front surface of the first blade 18. The retaining tabs 26 and 28 will prevent the free end 44 of the third blade 42 from moving further downwardly toward the handle 12. Thus, the blade assembly 30 is now securely mounted in assembled position and the spackling tool 10 may now be used to effectively apply a second coat of spackle to a wall surface.

After the second coat of spackle material dries, it is desirable to apply a third and final coat of spackle material to the wall surface. This should be performed with the free end 44 of the third blade 42. In order to perform this operation, it is necessary to loosen the wing nuts 56 and 58 and to remove the blade assembly 30 from its mounted position on the first blade 18. The blade assembly 30 should then be turned upside down, relative to its mounted position when the free end 34 of the second blade 32 is in a work position. The first blade 18 will again be placed within the pocket 60 of the blade assembly 30 between the guide members 52 and 54. However, this time, the free end 34 of the second blade 32 will be arranged adjacent to the retaining tabs 26 and 28 on the front surface of the first blade 18. The free end 44 of the third blade 42 will now be in a work position where it extends beyond the free end 22 of the first blade 18. The wing nuts 56 and 58 should again be tightened so that the blade assembly 30 is securely mounted in its assembled position.

After the third and final coat of spackle material is applied to the wall surface by the free end 44 of the third blade 42, the spackle material should be permitted to dry and the wall is ready to be painted.

Figure 5:
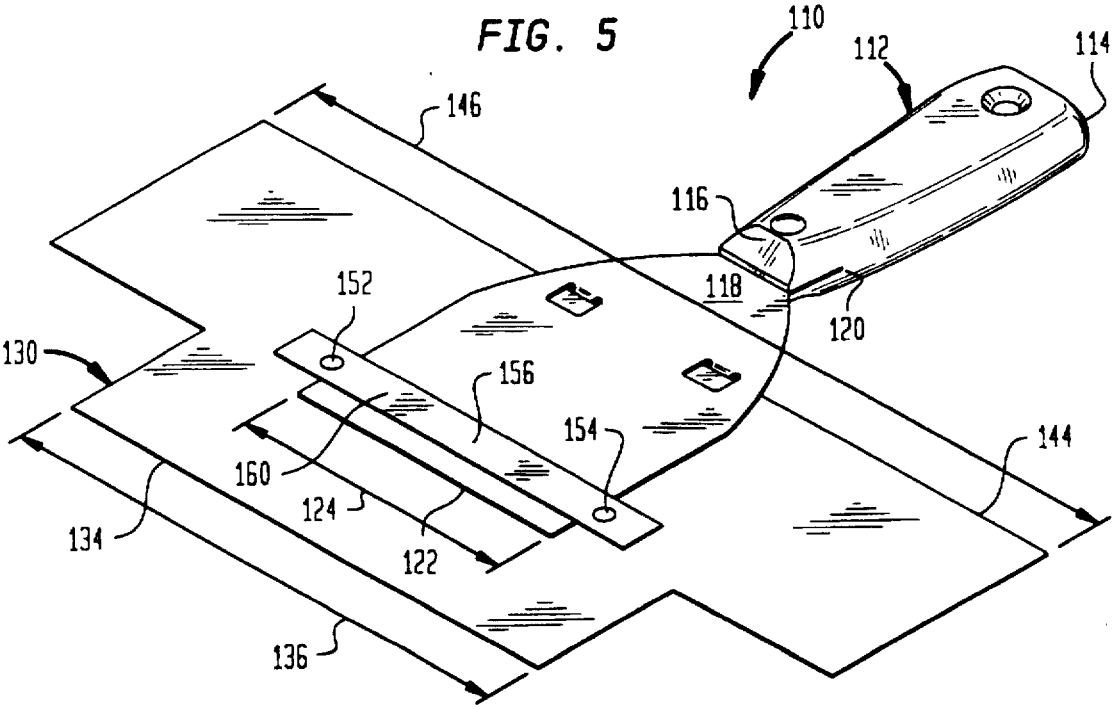
FIG. 5 is a front perspective view of a second embodiment of a spackling tool in assembled position with the free end of a second blade surface arranged in a work position.
Figure 6:
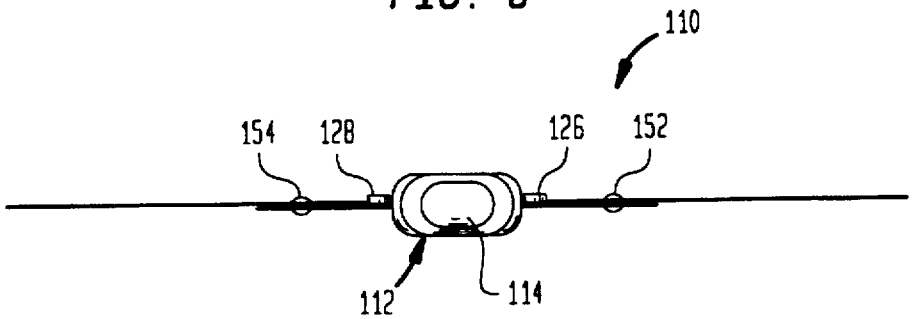
FIG. 6 is a rear view of the assembled spackling tool shown in FIG. 5.
Figure 7:
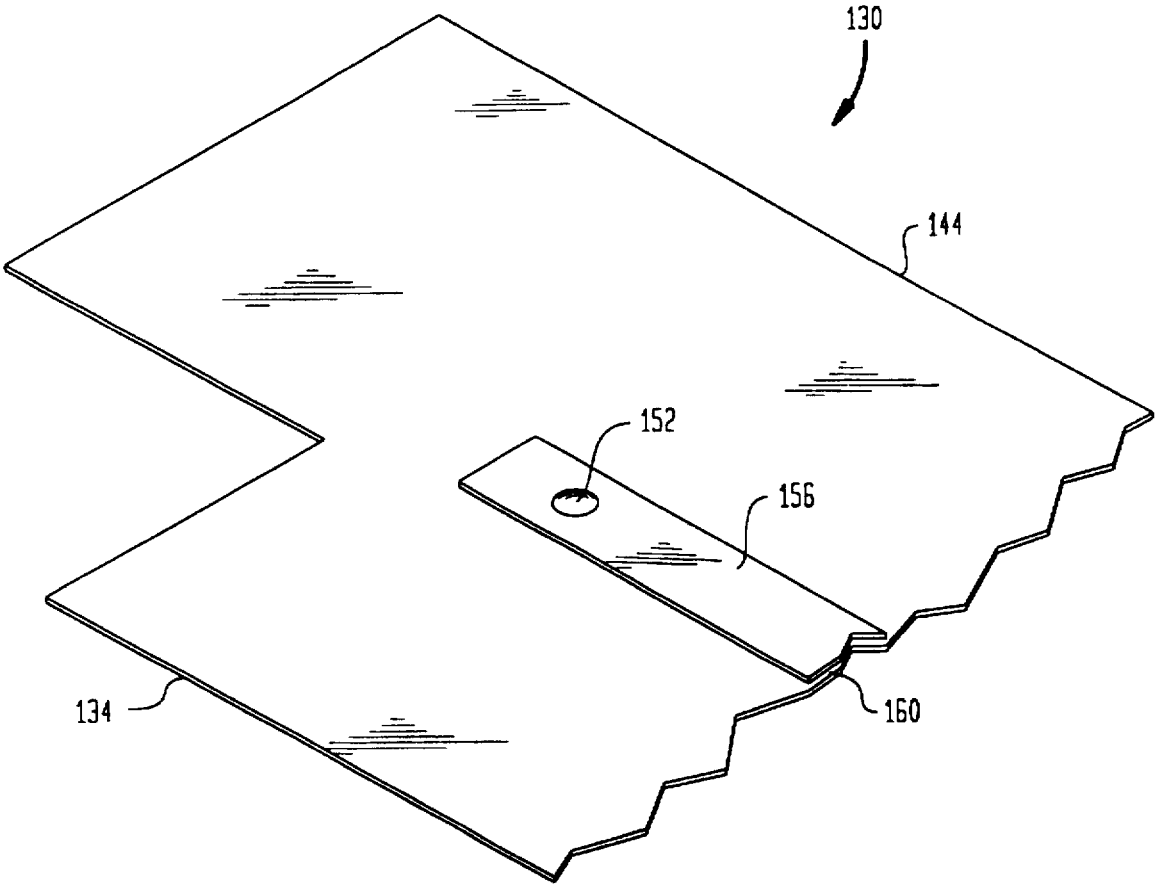
FIG. 7 is an isolated front perspective view of a second embodiment of the spackling tool including an integral second and third blade structure.

FIGS. 5–7 illustrate a second embodiment of the present invention where a spackling tool 110 is shown. The second embodiment is much like the first embodiment in that the free ends of the second and third blades are at opposing sides from each other. The difference between the first embodiment and the second embodiment shown in FIGS. 5–7 is that the second and third blades form an integral unit having the second and third free ends at opposing sides thereof.

Wherever possible, like numbers have been applied to the features of the second embodiment of the spackling tool shown in FIGS. 5–7. Each of the like numbers have been preceded by the number "1" to distinguish the first embodiment of FIGS. 1–4 from the second embodiment of FIGS. 5–7.

More particularly, spackling tool 110 shown in FIGS. 5–7 includes a handle generally designated 112. A first blade 118 is connected to the handle 112. A free end 122 of the first blade 118 is arranged at a location remote from the handle 112. As in the first embodiment of the present invention, the free end 122 has a predetermined width 124.

A pair of retaining tabs 126 and 128 are arranged on the front surface of the first blade 118 and extend outwardly therefrom for supporting a blade unit 130. As can be appreciated from FIGS. 5–7, the blade unit 130 is integral. This is different from the blade assembly 30 of the first embodiment of the present invention shown in FIGS. 1–4, where the second and third blades 32 and 42 are separate components.

The integral blade unit 130 includes a second blade 134 with a free end having a predetermined width 136 and a free end of a third blade 144 having a predetermined width 146. The free ends 134 and 144 are on opposing sides of the integral blade unit 130. A pair of rivets 152 and 154 are arranged on the integral blade unit 130 to secure a band 156 on an surface thereof which forms a pocket 160. The rivets 152 and 154 and the pocket 160 are analogous to the threaded bolts 52 and 54 and the pocket 60 of the first embodiment of the present invention. More particularly, the rivets 152 and 154 serve as guide members through which the free end 122 of the first blade 118 is arranged when the integral blade unit 130 is mounted in assembled position thereon.

Figure 8:
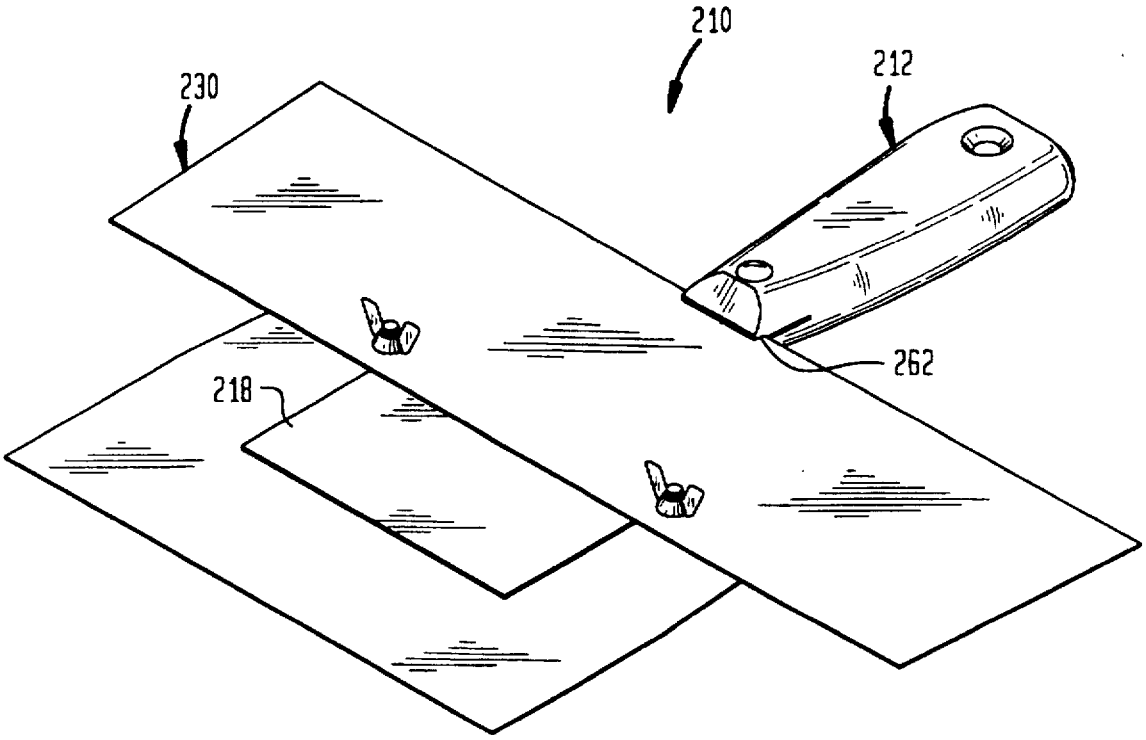
FIG. 8 is a front perspective view of a second embodiment of a spackling tool shown in assembled position with the second blade arranged in a work position.

Another embodiment of the present invention is shown in FIG. 8. The only difference between the spackling tool 210 illustrated in FIG. 8 and the spackling tool 10 shown in FIG. 1 relates to the retaining means for supporting the blade assembly 230 on the first blade 218. In particular the first blade 218 does not include retaining tabs extending from the surface thereof. Instead, the handle 212 includes a groove 262 arranged at the top end 216 in which the bottom end of the blade assembly 230 is supported.

It should be appreciated that the structure of the present spackling tool is not limited by the foregoing detailed description of the preferred embodiments, which are provided by way of preferred examples only. Various dimensions, materials and alternative structures are intended to come within the scope of the present invention which is limited only by the claims set forth below.

I claim:

1. A spackling tool comprising:

a handle for grasping said tool;

a first blade having a connecting end secured to said handle, and a free end spaced from said handle, said free end including a first predetermined width constructed and arranged to apply spackle material or the like to a wall surface, said first blade being substantially elongated and having generally flat opposing front and rear surfaces;

a second blade having a free end with a second predetermined width greater than said first predetermined width of said first blade, said second blade being substantially elongated and also having generally flat opposing front and rear surfaces and being removably mounted on said first blade, said free end of said second blade being arranged to extend beyond said free end of said first blade; and a third blade having a free end with a third predetermined width greater than said second predetermined width of said second blade, said third blade being substantially elongated and having generally flat opposing front and rear surfaces and being removably mounted on said first blade in conjunction with said second blade so that said free end of said third blade can selectively be arranged to extend beyond said free end of said first and second blades.

2. The spackling tool of claim 1 further comprising retaining means for supporting at least said second blade in assembled position on said first blade.

3. The spackling tool of claim 2 wherein said retaining means is formed at least partially on said front surface of said first blade.

4. The spackling tool of claim 3 wherein said retaining means comprises at least one tab extending outwardly from said front surface of said first blade, at least said second blade being supported by said at least one tab at a predetermined spaced distance from said handle.

5. The spackling tool of claim 4 further comprising a third blade having a free end with a third predetermined width greater than said second predetermined width of said second blade, said third blade being substantially elongated and having generally flat opposing front and rear surfaces and being removably mounted on said first blade in conjunction with said second blade so that said free end of said third blade can selectively be arranged to extend beyond said free end of said first and second blades.

6. The spackling tool of claim 5 wherein said second and third blades are secured together when mounted on said first blade.

7. The spackling tool of claim 2 wherein said retaining means is arranged on said handle.

8. The spackling tool of claim 5 wherein said retaining means comprises a groove on said handle, at least said second blade being supported within said groove on said handle.

9. A spackling tool comprising:

a handle for grasping said tool; a first blade having a connecting end secured to said handle, and a free end spaced from said handle, said free end including a first predetermined width constructed and arranged to apply spackle material or the like to a wall surface, said first blade being substantially elongated and having generally flat opposing front and rear surfaces;

second and third blades each having a free end and each being substantially elongated and having generally flat opposing front and rear surfaces, said second blade including a free end having a second predetermined width greater than said first predetermined width of said first blade, said third blade including a free end having a third predetermined width greater than said second predetermined width of said second blade, said second and third blades being secured together in a blade assembly so that said free ends of said second and third blades are arranged at opposing sides of said blade assembly, said blade assembly being removably and selectively mounted on said first blade so that said free end of said second or third blades extends beyond said free end of one of said first blade.

10. The spackling tool of claim 9 wherein said blade assembly comprises a pocket formed between said second and third blades, said first blade being arranged within said pocket when said blade assembly is mounted in assembled position on said first blade.

11. The spackling tool of claim 10 further comprising retaining means for supporting said blade assembly in assembled position on said first blade.

12. The spackling tool of claim 11 wherein said retaining means is formed at least partially on said front surface of said first blade.

13. The spackling tool of claim 11 wherein said retaining means comprises at least one tab extending outwardly from said front surface of said first blade, said blade assembly being supported by said at least one tab at a predetermined spaced distance from said handle.

14. The spackling tool of claim 13 wherein said free of said second blade is arranged to extend beyond said free end of said first blade when said free end of said third blade is adjacent said at least one tab of said retaining means, and said free end of said third blade is arranged to extend beyond said free end of said first blade when said free end of said second blade is adjacent so said at least one tab of said retaining means.

15. The spackling tool of claim 11 wherein said retaining means is arranged on said handle.

16. The spackling tool of claim 15 wherein said retaining means comprises a groove on said handle, at least said second blade being supported within said groove on said handle.

17. The spackling tool of claim 16 wherein said free end of said second blade is arranged to extend beyond said free end of said first blade when said free end of said third blade is adjacent said at least one tab of said retaining means, and said free end of said third blade is arranged to extend beyond said free end of said first blade when said free end of said second blade is adjacent so said groove of said retaining means.

18. The spackling tool of claim 10 further comprising guide members used to secure said second and third blades together, said guide members defining a width of said pocket of said blade assembly, said width being slightly greater than said first predetermined width of said free end of said first blade so that said first blade can extend within said pocket wherein said free end thereof extends between said guide members.

19. The spackling tool of claim 18 wherein said guide members comprise a pair of threaded bolts.

20. The spackling tool of claim 19 wherein said second and third blades have a pair of spaced apertures, said threaded bolts extending through said pair of apertures.

21. The spackling tool of claim 18 wherein said guide members comprises a pair of rivets.

22. The spackling tool of claim 19 further comprising a pair of threaded nuts arranged on respective ones of said pair of threaded bolts whereby said blade assembly can be selectively tightened or loosened in assembled position on said first blade upon tightening or loosening of said pair of threaded nuts.

23. The spackling tool of claim 9 wherein said first predetermined width of said first blade is between about 1"–5" wide, said second predetermined width of said second blade is between 3"–8" wide, and said third predetermined width of said third blade is between about 6"–14" wide.

24. The spackling tool of claim 23 wherein said first predetermined width of said first blade is between about 3"–4" wide, said second predetermined width of said second blade is between about 5"–7" wide, and said third predetermined width of said third blade is between about 8"–12" wide.

* * * * *

UNITED STATES PATENT AND TRADEMARK OFFICE

CERTIFICATE OF CORRECTION

PATENT NO. : 5,759,590

DATED : June 2, 1998

INVENTOR(S) : Cacossa

It is certified that error appears in the above-identified patent and that said Letters Patent is hereby corrected as shown below:

Column 4, line 25, "is held used" should read --is used--.

Column 4, line 34, "which have the" should read --which has the--.

Column 7, line 7, "on an surface" should read --on a surface--.

Column 8, line 60, "free of" should read --free end of--.

Column 8, line 66, "adjacent so said" should read --adjacent said--.

Column 9, line 13, "adjacent so said" should read --adjacent said--.

Column 10, line 5, "comprises" should read --comprise--.

Signed and Sealed this

First Day of September, 1998

Bruce Lehman

*Attest:*

BRUCE LEHMAN

*Attesting Officer*

*Commissioner of Patents and Trademarks*